US006452168B1

(12) United States Patent
McLuckey et al.

(10) Patent No.: US 6,452,168 B1
(45) Date of Patent: Sep. 17, 2002

(54) APPARATUS AND METHODS FOR CONTINUOUS BEAM FOURIER TRANSFORM MASS SPECTROMETRY

(75) Inventors: Scott A. McLuckey, Oak Ridge, TN (US); Douglas E. Goeringer, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 09/396,839

(22) Filed: Sep. 15, 1999

(51) Int. Cl.[7] ..... H01J 49/42

(52) U.S. Cl. ..... 250/292; 250/282

(58) Field of Search ..... 250/292, 282, 250/290–294

(56) References Cited

U.S. PATENT DOCUMENTS 4,686,365 A * 8/1987 Meek et al. ..... 250/281
4,755,670 A 7/1988 Syka et al. ..... 250/292
6,011,259 A * 1/2000 Whitehouse et al. ..... 250/287

OTHER PUBLICATIONS

Zerega et al., "A New Operating Mode of a Quadrupole Ion Trap in Mass Spectrometry, Part 1., Signal Visiblility," Int. J. Mass. Spec. Ion Proc., 132, pp. 57–65 (1994).
Zerega et al., "A New Operating Mode of a Qadrupole Ion Trap in Mass Spectrometry, Part 2., Multichannel Recording and Treatment of the Ion Times of Flight," Int. J. Mass. Spec. and Ion Proc., 132, pp. 67–72 (1994).
Buchanan, et al., "Fourier Transform Mass Spectrometry of High–Mass Biomolecules," Anal. Chem., vol. 65, No. 5, pp. 245A–259A (1993).
Zerega, et al., "Mass Discrinination of Isotopic Xe+ Ions Ejected From an r.f. Quadrupole Trap: Fourier Analysis of the Ion Signal for Selected Time–of–Flight Measurements Related to Ion Position in the Trap," Int. J. Mass. Spec. Ion Proc., 121, pp. 77–86 (1992).
Marshall, et al., "Fourier Transform Ion Cyclotron Resonance Mass Spectrometry: Technique Developments," Int. J. Mass. Spec. Ion Proc., 118/119, pp. 37–70 (1992).
Marshall, et al., "Fourier Transform Ion Cyclotron Resonance Mass Spectrometry: The Teenage Years," Anal. Chem., vol. 63, No. 4, pp. 215A–229A (1991).
Brincourt, et al., "Time–of–Flight Detection of Ions Ejected from a Radiofrequency Quadrupole Trap: Experimental Determination of Their fz Secular Frequency," Chem. Phy. Ltrs., vol. 174, N. 6, pp. 626–630 (1990).
Knorr et al., "Fourier Transform Time–of–Flight Mass Spectrometry," Anal. Chem. 58, pp. 690–694 (1986).
Comisarow, et al., "Selective–phase Ion Cyclotron Resonance Spectroscopy," Can. J. Chem., 52, pp. 1997–1999 (1974).
Comisarow, et al., "Frequency–Sweep Fourier Transform Ion Cyclotron Resonance Spectroscopy," Chem. Phy. Ltrs. vol. 26, N. 4, pp. 489–490 (1974).
Comisarow, et al., "Fourier Transform Ion Cyclotron Resonance Spectroscopy," Chem. Phy. Ltrs., vol. 25, N. 2, pp. 282–283 (1974).

* cited by examiner

*Primary Examiner*—Bruce Anderson
*Assistant Examiner*—Zia R. Hashmi
(74) *Attorney, Agent, or Firm*—Shelley L. Stafford; J. Kenneth Davis

(57) ABSTRACT

A continuous beam Fourier transform mass spectrometer in which a sample of ions to be analyzed is trapped in a trapping field, and the ions in the range of the mass-to-charge ratios to be analyzed are excited at their characteristic frequencies of motion by a continuous excitation signal. The excited ions in resonant motions generate real or image currents continuously which can be detected and processed to provide a mass spectrum.

48 Claims, 5 Drawing Sheets

APPARATUS AND METHODS FOR CONTINUOUS BEAM FOURIER TRANSFORM MASS SPECTROMETRY

STATEMENT REGRADING FEDERALLY SPONSORED RESEARCH OR DEVELOPMENT

This invention was made with Government support under Contract No. DE-AC05-96OR22464 awarded by the U.S. Department of Energy to Lockheed Martin Energy Research Corp., and the Government has certain rights in this invention.

BACKGROUND OF THE INVENTION

1. Field of the Invention

The present invention relates to an apparatus and methods for continuous beam Fourier transform mass spectrometry. In particular, the invention relates to an apparatus and methods for providing a mass spectrum of a continuous beam of ions.

2. Background Art

Mass spectrometry is an analytical tool for identification of chemical structures, determination of mixtures, and quantitative elemental analysis of organic compounds, based on application of the mass spectrometer.

Mass spectrometer is an instrument used for determining the masses of atoms or molecules found in a sample of gas, liquid, or solid. The mass spectrometer was originally developed as a nuclear physics research tool. Today, mass spectrometers are widely used in various types of institutions, laboratories, industries and other related entities to measure and identify minute quantities of various substances.

Several types of mass spectrometer are currently available. A traditional design of a mass spectrometer is based on the combination of electrostatic and magnetic sector fields. FIG. 1 illustrates how such a mass spectrometer works. In an ion source 1, atoms or molecules are ionized by bombarding them with electrons to become electrically charged atoms or molecules, i.e., ions. The ions are then extracted by an electric field (not shown) to form a beam 3 of ions. A slit 2 is used to define the beam. Beam 3 enters an electrostatic energy analyzer 4, where a sector electric field $E_1$ focuses ions onto an intermediate slit 5. The ion 6 that pass through the intermediate slit 5 then pass into a uniform sector magnetic field B presented in region 7. Thus, ions 6 with energy E in region 7 are deflected into a circular path with radius R=mv/qB by the uniform magnetic field until they strike either a photographic or electronic detector 8 at a location proportional to their mass, since the radius of curvature increases with mass. This forms a mass spectrum that allows one to separate ions with the same charge but different masses. For example, ions strike the detector 8 at position 9 would have greater mass than the than ions the strike detector 8 at either positions 10 or 11. Alternatively, ions 6 can be allowed to sweep across a slit (not shown) in front of a detector by scanning the magnetic field or the accelerating potential.

Another form of mass spectrometry is referred to as ion cyclotron resonance. In this case, ions are either found within or are allowed to drift through a uniform magnetic field where they execute cyclotron motion according to $\omega=qB/m$. The ions can be detected by scanning the magnetic field while applying a sinusoidal electric signal to a pair of opposing plates placed on either side of the ion beam or cloud. A signal is generated by use of a tuned circuit to detect the power absorbed by ions that come into resonance with the applied signal. Alternatively, ions can be detected by measuring the image currents generated on a pair of plates placed orthogonally to the plates used to excite the ions.

Fourier transform techniques have been applied to ion cyclotron resonance to provide a Fourier transform ion cyclotron resonance ("FTICR") mass spectrometer. FTICR uses a uniform magnetic field to trap ions to be analyzed and an excitation pulse to excite the ions into coherent motions so that they can be detected. In FTICR, ion formation, ion excitation, and ion detection are done sequentially in time. Such FTICR mass spectrometers thus have a disadvantage of low duty cycle for continuous analyte consumption.

Fourier transform quadrupole mass spectrometer is another type of existing mass spectrometers. It uses a two or three dimensional electrostatic trapping field to trap ions to be analyzed and an excitation pulse to excite the ions into coherent motions so that they can be detected. Like in FTICR, here ion formation, ion excitation, and ion detection are done sequentially in time. Thus, it also has a disadvantage of low duty cycle.

Additionally, the existing Fourier transform mass spectrometers have a second disadvantage in that they have a poor dynamic range and are slow. The third disadvantage they have is that resolution can be degraded due to ion-ion and ion-molecule collisions because they have to keep the ions trapped for a relatively long time to get the measurement done and by other factors including field imperfections.

SUMMARY OF THE INVENTION

The disadvantages of the prior art are overcome by the present invention, which, in one aspect, is a continuous beam Fourier transform mass spectrometer that is capable of providing a mass spectrum with less dependence upon ion collisions and can be operated in a 100% duty cycle. The present invention, in analyzing ions trapped in a confinement structure, utilizes a continuous excitation signal, instead of an excitation pulse used in the prior art, to the confinement structure to cause resonant motions of the ions. The signals responsive to the resonant motions of the ions can then be detected to produce a mass spectrum.

In one aspect, the present invention relates to a continuous Fourier transform mass spectrometer that includes a confinement structure having a cavity, a first opening and a second opening. The spectrometer also includes means for applying an RF voltage to the structure to form a trapping field in the cavity and means for supplying a continuous beam of ions through the first opening to the cavity to form a sample of ions with a range of masses. The sample ions are trapped in the trapping field and each ion is characterized by a mass-to-charge dependent frequency of motion. The spectrometer further includes means for continuously applying an excitation signal having a frequency spectrum and an amplitude to the trapped sample ions. The frequency spectrum of the excitation signal includes characteristic frequencies corresponding to at least one of the mass-to-charge dependent frequencies of motion of the sample ions, and the amplitude of the excitation signal is sufficient high to cause resonant motions of the ions with at least one of the characteristic frequencies of the excitation signal. The spectrometer further has means for detecting signals responsive to the resonant motions of the ions, wherein the second opening allows at least some of the sample ions to exit the cavity. Because the ions are continuously fed into the cavity and excited into resonant motions continuously by the excitation signal that can be detected continuously, the spectrometer can offer a mass spectrum with fewer ion collisions and can be operated in a 100% duty cycle.

In another aspect, the invention is a continuous beam Fourier transform mass spectrometer including a quadrupole structure having end caps and a ring electrode. The end caps and the ring electrode are spaced apart from each other thereby defining a cavity that includes a first opening and a second opening communicating with outside. The spectrometer has means for applying an RF voltage to the ring electrode to form a three-dimensional trapping field in the cavity. Furthermore, the spectrometer includes ion beam means for supplying a continuous beam of ions through the first opening to the cavity to form a sample of ions with a range of masses. The sample ions are trapped in the trapping field and each ion is characterized by a mass-to-charge dependent frequency of motion. The spectrometer further has excitation means for continuously applying an excitation signal having a frequency spectrum, which includes characteristic frequencies corresponding to at least one of the mass-to-charge dependent frequencies of motion, to at least one of the end caps to cause resonant motions of the trapped sample ions with at least one of the characteristic frequencies of the excitation signal. The ions in resonant motions are ejected away from the cavity through the second opening continuously thereby to form a current. The spectrometer has means for detecting the current and produces a mass spectrum from the detected current.

In a further aspect, the invention relates to a continuous beam Fourier transform mass spectrometer that has a quadrupole structure having a plurality of linear quadrupole rods. The linear quadrupole rods are spaced parallel and apart from each other thereby defining a bore extending axially between the ends of the structure. The bore has a longitudinal axis. The spectrometer has means for applying RF voltage signals selectively to the rods so that RF voltage signals applied to adjacent rods are 180° out-of -phase and RF voltage signals applied to opposing rods are in-phase thereby to form a two-dimensional trapping field radially in the bore. The spectrometer also has means for supplying a continuous beam of ions through one end of the structure to the bore along the longitudinal axis to form a sample of ions with a range of masses. The sample ions are trapped by the trapping field radially and transmitted through the bore axially, with each ion characterized by a mass-to-charge dependent frequency of motion. The spectrometer further includes excitation means for continuously applying an excitation signal having a frequency spectrum, which includes characteristic frequencies corresponding to at least one of the mass-to-charge dependent frequencies of motion, to a pair of opposing rods to cause resonant motions of the trapped sample ions with at least one of the characteristic frequencies of the excitation signal. The ions in resonant motions move in expanded radii of motion. The spectrometer has means for detecting the ions in resonant motions and produces a mass spectrum accordingly.

The present invention in yet another aspect relates to a continuous beam Fourier transform mass spectrometer that includes a cell structure having a first pair and second pair of opposing plates and a bore extending between the ends of the structure. The bore has a longitudinal axis. The spectrometer has means for applying a uniform magnetic field in the bore. The magnetic field has a direction along the longitudinal axis thereby to form a two-dimensional trapping field radially in the bore. The spectrometer also has ion beam means for supplying a continuous beam of ions through one end of the structure to the bore along the longitudinal axis to form a sample of ions with a range of masses. The sample ions are trapped radially in the bore and each ion is characterized by a mass-to-charge dependent frequency of motion. The spectrometer further includes excitation means for continuously applying an excitation signal having a spectrum of frequency and an amplitude to the first pair of opposing plates to cause resonant motions of the trapped sample ions with at least one of the characteristic frequencies of the excitation signal. The ions in resonant motions move in expanded radii of motion thereby to approach the second pair of the opposing plates and induce an image current therein. The spectrometer has means for detecting the image current and produces a mass spectrum accordingly.

Yet another aspect of the present invention is related to a method of mass analyzing ions trapped in a confinement structure, wherein the confinement structure has a cavity. A trapping field is formed in the cavity and a continuous beam of ions is supplied therein to form a sample of ions with a range of masses. The sample ions are trapped in the trapping field and each ion is characterized by a mass-to-charge dependent frequency of motion. An excitation signal having a frequency spectrum and an amplitude is continuously applied to the trapped sample ions, wherein the frequency spectrum of the excitation signal includes characteristic frequencies corresponding to at least one of the mass-to-charge dependent frequencies of motion of the sample ions, and the amplitude of the excitation signal is sufficiently high to cause resonant motions of the ions with at least one of the characteristic frequencies of the excitation signal. Signals responsive to the resonant motions of the ions are then detected to produce a mass spectrum accordingly.

In yet another aspect, the present invention relates to a method of mass analyzing ions trapped in a cell structure, wherein the cell structure has a bore, the bore having a longitudinal axis and extending axially between a first and a second openings. A magnetic field is applied to the cell structure to form a trapping field in the bore. The magnetic field has a direction parallel to the longitudinal axis. A continuous beam of ions is supplied through the first opening to the bore to form a sample of ions with a range of masses. The sample ions are trapped radially in the trapping field and each ion is characterized by a mass-to-charge dependent frequency of motion. An excitation signal having a frequency spectrum and an amplitude is continuously applied to the trapped sample ions, wherein the frequency spectrum of the excitation signal includes characteristic frequencies corresponding to at least one of the mass-to-charge dependent frequencies of motion of the sample ions, and the amplitude of the excitation signal is sufficient high to cause resonant motions of the ions with at least one of the characteristic frequencies of the excitation signal. The signals responsive to the resonant motions of the ions are detected to produce a mass spectrum accordingly.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

The present invention is more particularly described in the following examples that are intended as illustrative only since numerous modifications and variations therein will be apparent to those skilled in the art. As used in the specification and in the claims, "a" can mean one or more, depending upon the context in which it is used. The preferred embodiment is now described with reference to the FIGS. 2–5, in which like numbers indicate like parts throughout the FIGS. 2–5.

The Overview

Referring generally to FIGS. 2–5, the present invention comprises a continuous beam Fourier transform mass spectrometer that is capable of providing a mass spectrum with minimal susceptibility to ion collisions and can be operated in a 100% duty cycle.

Figure 1:
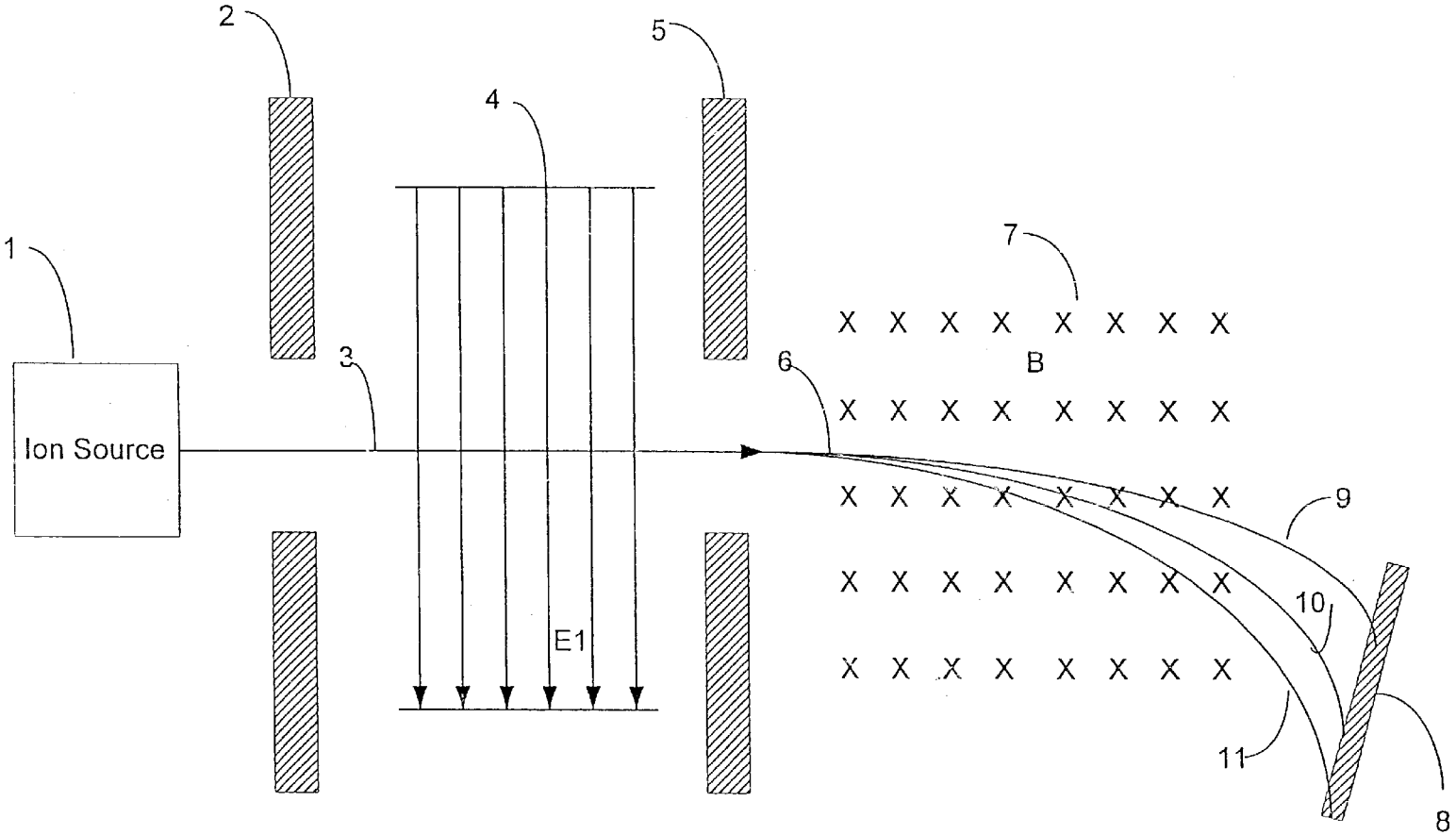
FIG. 1 (Prior Art)
FIG. 1 displays a basic structure for a mass spectrometer.
Figure 2:
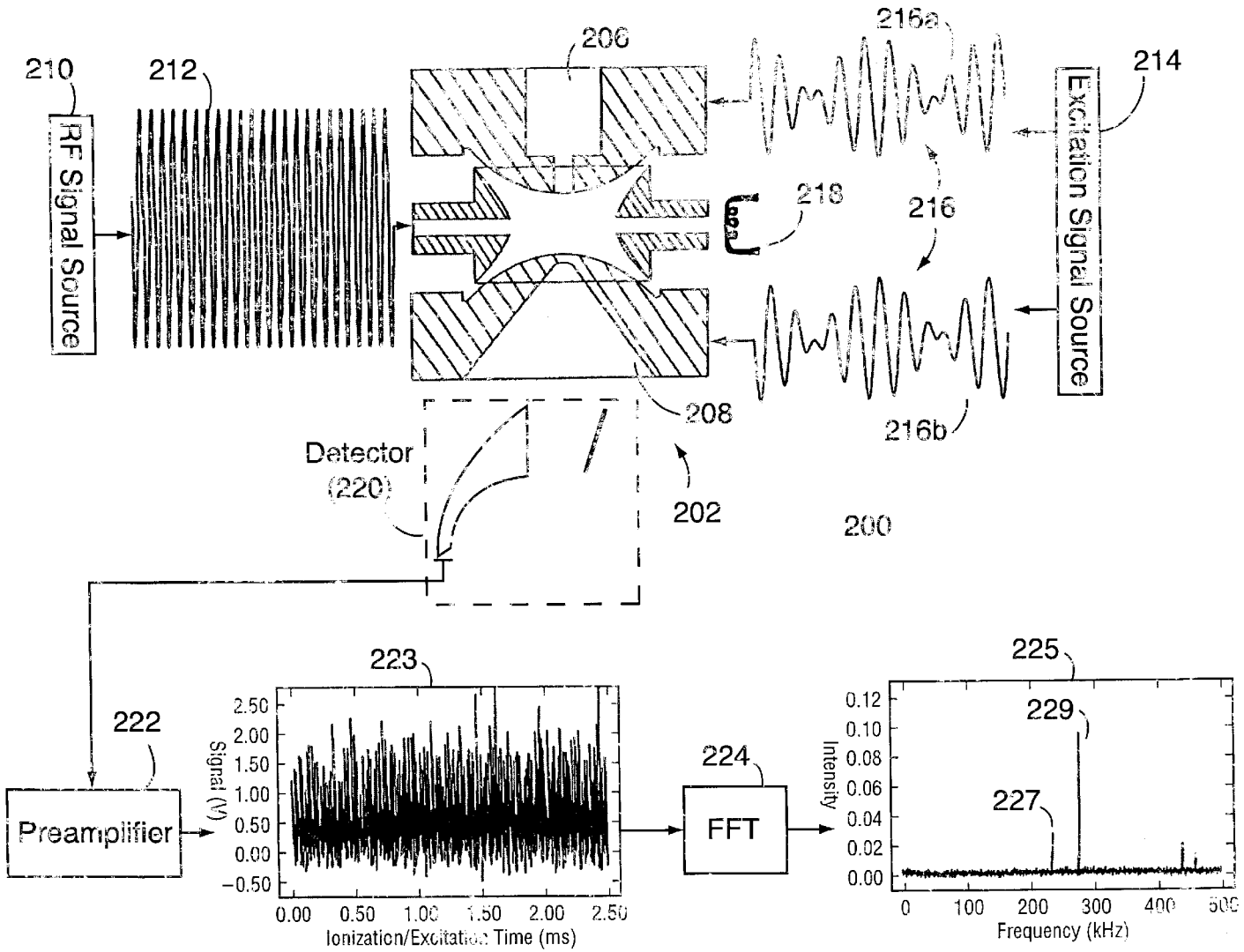
FIG. 2 displays schematically a partial block diagram for a continuous beam Fourier transform mass spectrometer according to a preferred embodiment of the present invention.

Referring to FIG. 2, a continuous beam Fourier transform mass spectrometer 200 in one embodiment of the present invention includes a confinement structure 202. The confinement structure 202 has a cavity 204. Cavity 204 can communicate with outside through a first opening 206 and a second opening 208. A continuous ion beam from an ion source (not shown) can be introduced into the cavity 204 through the first opening 206. Confinement structure 202 can be a quadrupole electrode structure as shown in FIG. 2. The quadrupole electrode structure can be constructed to have either an three-dimensional electric trapping field or a two-dimensional electric trapping field. Confinement structure 202 can also be a cyclotron structure or other structures known to people skilled in the art.

Confinement structure 202 is electrically coupled with an electrodynamic field source 210 to create a trapping field in the cavity 204. If the confinement structure 202 is a quadrupole electrode structure as shown in FIG. 2, this field source 210 should be an RF voltage supply which is capable of applying an RF high voltage signal 212 with a stable frequency to create a trapping field in the cavity 204. If the confinement structure 202 is a cyclotron structure, alternatively, this field source 210 should be a magnetic field supply which is capable of applying a magnetic field in the cavity 204.

Confinement structure 202 is also electrically coupled with an excitation electronics 214. The excitation electronics 214 includes at least one excitation waveform generator that is capable of creating a continuous waveform 216*a* or 216*b* or both to excite the trapped ions into coherent resonant motions.

The mass spectrometer 200 also includes a detector 220. In the embodiment shown in FIG. 2 where the quadrupole electrode structure is used, detector 220 is located outside the confinement structure 202 but in proximity to the second opening 208 so that ions exiting the cavity 204 through the second opening 208 may be detected by the detector 220. Detector 220 may include an electron multiplier for ion detection. Or, detector 220 may include a current monitor for ion detection. Additionally, a preamplifier 222 is electrically coupled to the detector 220. And a fast Fourier transformer 224 is coupled to the amplifier 222.

Still referring to FIG. 2, to perform a mass analysis of target ions, a continuous beam of the ions is introduced into cavity 204 through the first opening 206 to form a sample of ions with a range of masses. Inside cavity 204, a trapping field is established by the field source 210. In this embodiment, the field source 210 applies an RF voltage 212 to establish an electric trapping field. The sample ions are trapped by the trapping field and each ion is characterized by a mass-to-charge dependent frequency of motion. The excitation electronics 214 applies an excitation signal 216 to excite the trapped ions. Unlike the prior art where an excitation impulse is used to excite ions, the excitation signal 216 is a continuous waveform. The excitation signal 216 has a spectrum of frequency that includes characteristic frequencies corresponding to at least one of the mass-to-charge dependent frequencies of motion of the sample ions. The amplitude of the excitation signal 216 is selected to be sufficiently high to cause resonant motions of the ions with at least one of the characteristic frequencies of the excitation signal 216.

The ions in resonant motions are ejected away from cavity 204 through the second opening 208 and are detected by detector 220. Because an ion beam is fed into the cavity 204 and interacted with the trapping field and the excitation signal 216 continuously, ions in resonant motions with at least one of the characteristic frequencies of the excitation signal 216 are continuously ejected away from cavity 204 and strike the detector 220 to yield a current. The current may include a DC component and an AC component. Detector 220 may utilize proper devices such as capacitors to selectively detect the AC component of the current. This current can be amplified by the preamplifier 222 to have a time-domain signal 223. The Fast Fourier transformer 224 receives the time-domain signal 223 and converts it into a frequency spectrum 225. The peaks 227, 229 displayed at the frequency spectrum 225 represent the resonant frequencies at which the ions are ejected from the cavity 204. These frequencies can then be used to identify the mass of the sample ions.

As discussed above, the excitation signal 216 has a spectrum of frequencies. FIG. 2 shows that the excitation signal 216 having two waveforms 216*a*, 216*b*, each corresponding to one characteristic frequency, is simultaneously applied to the sample ions. The peaks 227, 229 displayed at the frequency spectrum 225 indicate that there are ions among the sample ions whose mass-to-charge dependent frequencies of motion are substantially same to the two characteristic frequencies of the excitation signal 216. Because the two characteristic frequencies of the excitation signal 216 are known to correspond to certain material, in this case, nitrogen (with mass/charge m/z=28) and oxygen (with mass/charge m/z=32), the peaks 227, 229 displayed at the frequency spectrum 225 show that nitrogen and oxygen ions are present in the sample ions.

The cavity 204, as known to people skilled in the art, should be kept in vacuum before the ion beam is introduced. An optional filament 218 can be utilized to inject electrons into the cavity 204 to ionize the sample, rather than use of an external ion source.

Because in the present invention, the sample ions are continuously fed into the system and ions in resonant motions with the characteristic frequencies of the excitation signals are continuously ejected away from the cavity, detected and analyzed, the probability of ion-ion interactions can be greatly reduced, the resolution of the frequency spectrum as well as mass spectrum can be improved, the 100% duty cycle can be substantially achieved, and dynamic mass spectrometry becomes possible.

Figure 3:
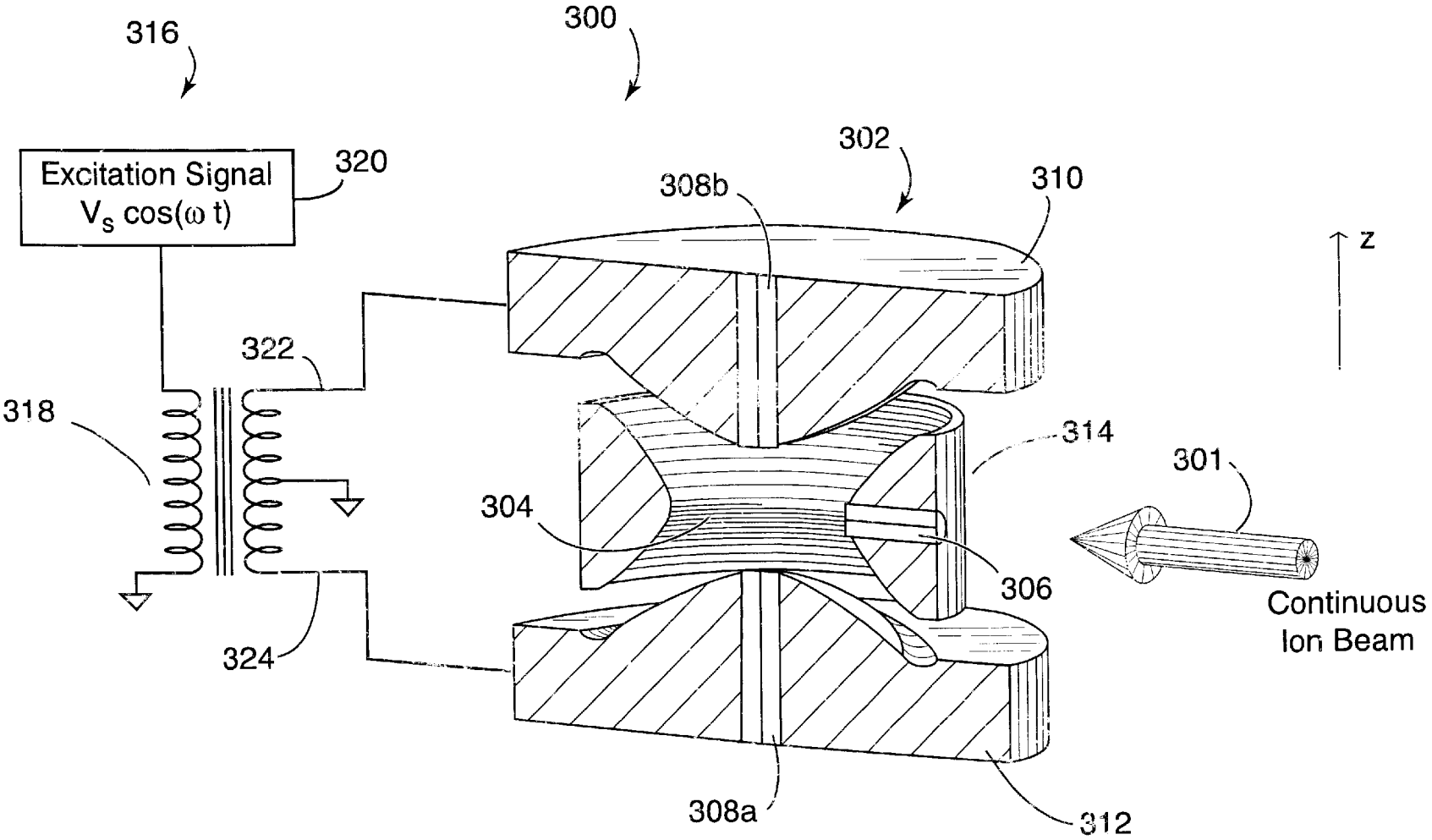
FIG. 3 displays schematically a partial, cut-away sectional view of a continuous beam Fourier transform mass spectrometer utilizing a three-dimensional quadrupole structure according to one embodiment of the present invention.
Figure 4:
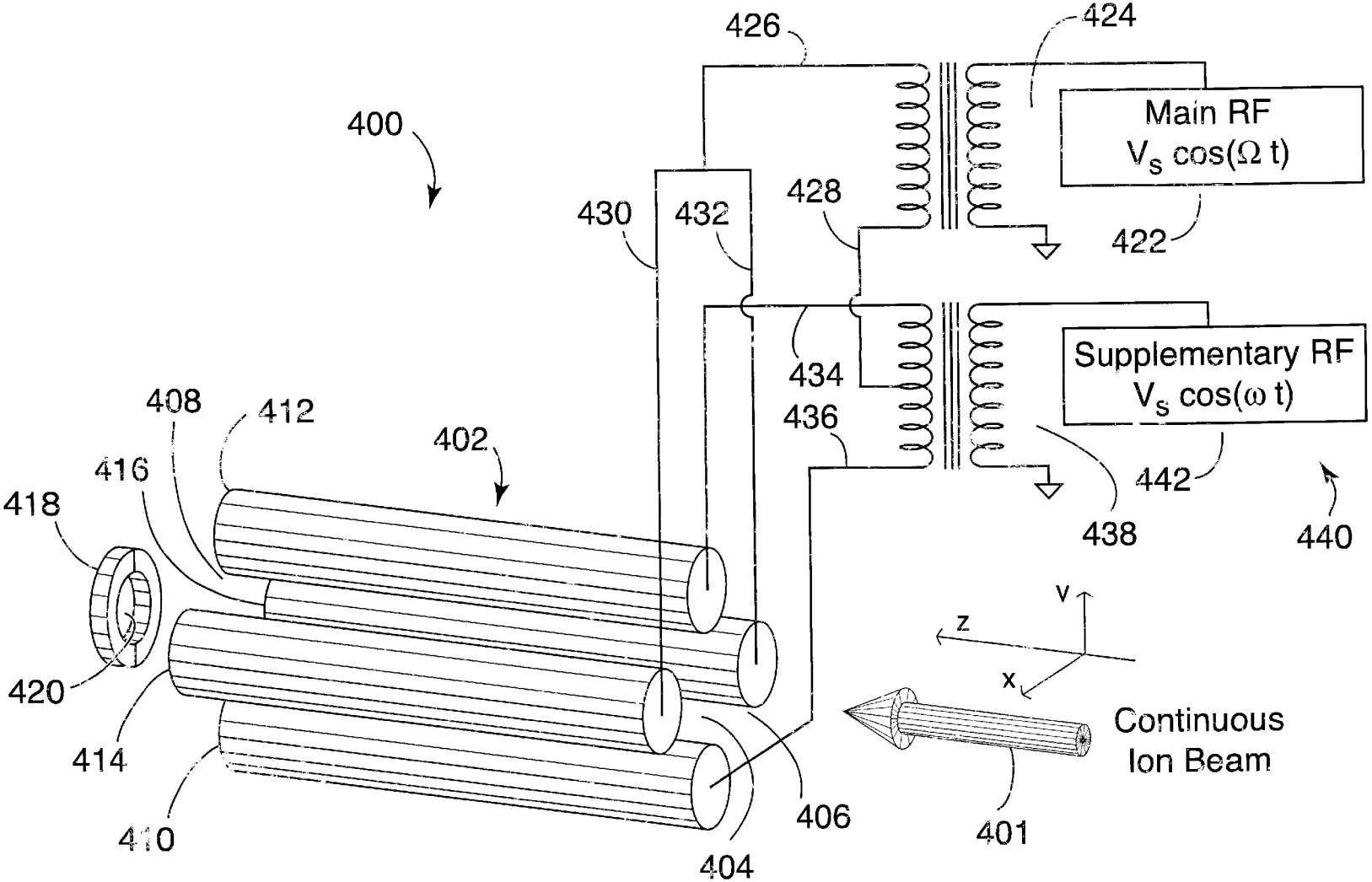
FIG. 4 displays schematically a partial, cut-away sectional view of a continuous beam Fourier transform mass spectrometer utilizing a two-dimensional quadrupole structure according to another embodiment of the present invention.
Figure 5:
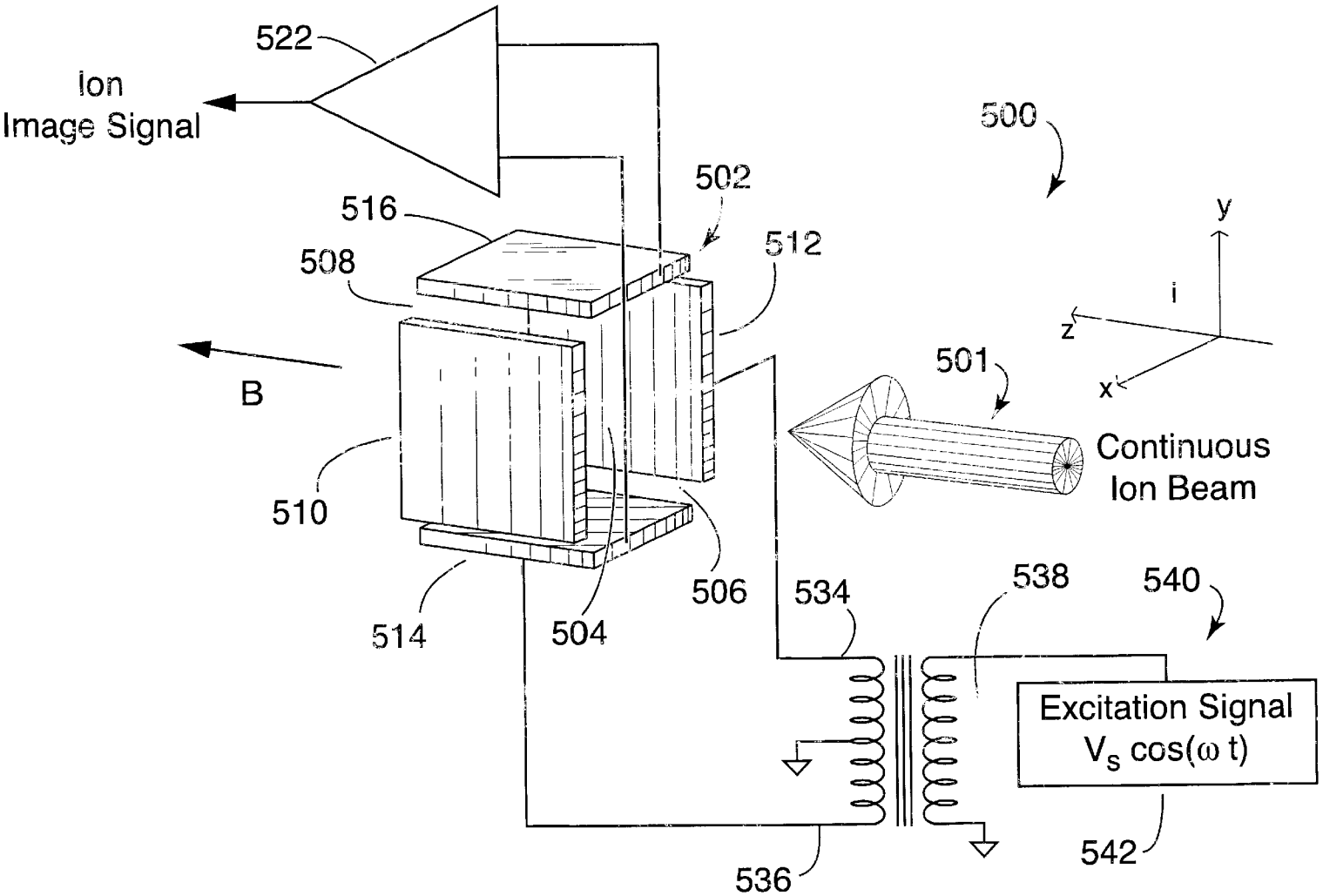
FIG. 5 displays schematically a partial, cut-away sectional view of a continuous beam Fourier transform mass spectrometer utilizing a uniform magnetic field associated with a cell structure according to a further embodiment of the present invention.

The invention, especially the confinement structure used to practice the invention, will be better understood by reference to the following embodiments, which are illustrated in FIGS. 3–5.

Three-Dimensional Quadrupole Embodiment

FIG. 3 partially shows a continuous beam Fourier transform mass spectrometer 300 according to one embodiment of the present invention in a cut-away, side-view. The spectrometer 300 includes a three-dimensional quadrupole confinement structure 302. Confinement structure 302 includes two opposing endcap electrodes 310, 312 and ring electrode 314. Endcap electrodes 310, 312 and ring electrode 314 are positioned relatively to form a cavity 304. Endcap electrodes 310, 312 are electrically coupled together. Ring electrode 314 is electrically coupled to a trapping field source (not shown) which is capable of applying an RF voltage to the ring electrode 314 so that a trapping field can be established inside cavity 304. For the embodiment shown in FIG. 3, endcap electrodes 310, 312 and ring electrode 314 have appropriate hyperbolic contours to generate a three-dimensional quadrupole electric field inside cavity 304. A more complete description of a quadrupole device capable of trapping ions inside may be found in U.S. Pat. No. 4,755,670 to Syka et al., which is incorporated herein by reference for the purpose of providing background information only.

Cavity 304 can communicate with outside of the confinement structure 302 through openings 306, 308*a* and 308*b*. An ion beam 301 can be introduced into cavity 304 through opening 306 as shown in FIG. 3. Alternatively, an ion beam can be introduced into cavity 304 through opening 308*a* or 308*b* as well. Moreover, cavity 304 can have more openings to accommodate particular needs. For instance, confinement structure 302 can have an opening opposing opening 306. Ion beam 301 can have ions with different physical properties such as different mass, different charge, etc. In other words, ion beam 301 can have ions within a mass spectrum. However, not any ion with any mass can be trapped in cavity 304. The range of mass-to-charge ratios that can be stored simultaneously in the ion trap is defined by the electrode geometry and the amplitude and frequency of the main RF voltage applied to the endcap electrodes. Typically, for an ion trap with a ring electrode 314 having a radius of about 1.0 cm and the normal spacings (i.e., 1.707 times the radius of the ring electrode 314) for the endcap electrodes 310, 312, the radio frequency for the main RF signal is about 0.5–2.0 MHZ and the amplitude of the main RF signal ranges from tens of volts to a few thousand volts.

An excitation electronics 316 is electrically coupled to at least one of the endcap electrodes 310 and 312. Excitation electronics 316 is capable of continuously applying an excitation signal to the endcap electrodes 310 and 312 and therefore to affect the electric field distribution in cavity 304. For the embodiment shown in FIG. 3, the excitation electronics 316 includes a transformer 318. The transformer 318 is electrically coupled to a signal source 320, which can be, for example, a signal generator. Additionally, the transformer 318 is electrically coupled to the endcap electrodes 310, 312 through legs 322, 324, respectively in dipolar fashion. That is, the same excitation signal is applied to each endcap electrode 180° out-of-phase. Alternatively, the transformer 318 can be electrically coupled to the endcap electrodes 310, 312 in a monopolar fashion so that the excitation signal from signal source 320 can be applied to only one of the endcap electrodes 310, 312.

Referring now to both FIGS. 2 and 3, the following is an example of how mass analysis is performed with the described embodiment of the present invention. An RF voltage is applied to the ring electrode 314 to establish a three-dimensional trapping field in the cavity 304. An ion beam 301 is introduced continuously into the cavity 304 through opening 306 to form a sample of ions therein with a mass range. The sample ions are trapped in the cavity 304 by the three-dimensional trapping field. Each of the sample ions is characterized by a mass-to-charge dependent frequency. Meanwhile, the excitation signal is applied to the cavity 304 from signal source 320 through transformer 318 and endcaps 310, 312 continuously. The excitation signal has a frequency spectrum that includes characteristic frequencies corresponding to at least one of the mass-to-charge dependent frequencies of motion of the sample ions. In operation, the excitation waveform is chosen so as to excite all ions within the mass range of interest. The amplitude of the excitation signal is chosen to be sufficiently high to cause resonant motions of the trapped ions with at least one of the characteristic frequencies of the excitation signal. In general, the amplitude of the excitation signal is in a range of hundreds of millivolts to several volts. This causes acceleration or coherent resonant motion along the z axis for excited trapped ions with characteristic frequencies within the frequency spectrum of the excitation signal. These ions in resonant motions are thus ejected away by the excitation signal from cavity 304 through opening 308*a*. A detector (not shown in FIG. 3) receives the ejected ions and yields a time-domain signal responsive to the received ions. A Fourier transform of the time-domain signal from the detector results in a frequency spectrum that can be calibrated to yield a mass spectrum. Because the ion beam 301 is continuously fed into the cavity 304 and the excitation signal likewise is continuously applied to the cavity 304, trapped ions are continuously excited and ejected away from the cavity 304 through the opening 308*a* thereby to form a flux of ions in resonant motions, which, when detected by the detector, results in a continuous current signal. In contrast to prior art where the excitation signal is applied to the trapped ions in the form of an energy pulse, which generates a short-lived and often weak current signal, the continuous current signal generated by the embodiment of the present invention, shown in FIG. 3, makes a high speed, dynamic, and a 100% duty cycle mass spectrometer possible.

Two-Dimensional Quadrupole Embodiment

FIG. 4 partially shows a continuous beam Fourier transform mass spectrometer 400 according to another embodiment of the present invention in a cut-away, side-view. The spectrometer 400 includes a conventional linear quadrupole rod electrode structure 402 defined by linear quadrupole rod electrodes 410, 412, 414, and 416. These rod electrodes are spaced parallel and apart from each other to define a bore 404. The bore 404 extends axially between the opening ends 406, 408 of the confinement structure 402. Bore 404 has a longitudinal axis along the z-direction. A ring-shaped detector 418 is positioned co-axially at the opening end 408. The ring-shaped detector 418 has an opening 420 at its center so that when it is placed at the opening end 408, bore 404 can still communicate with outside through opening end 408. The ring-shaped detector 418 is sized so that it can fit into the opening end 408 tightly and it can detect the ions of interest only, as further discussed below.

An ion beam 401 can be introduced into bore 404 through opening 406 as shown in FIG. 4. Ion beam 401 can have ions with different physical properties such as different mass, different charge, etc. In other words, ion beam 401 can have ions with a mass spectrum. Once inside bore 404, each ion is contained or trapped in the x and y directions but can pass through in the z direction. The range of mass-to-charge ratios that can be stored simultaneously in the bore 404 is defined by the electrode geometry and the amplitude and frequency of the main RF voltage applied to the rod electrodes.

Linear quadrupole rod electrodes 410, 412, 414, and 416 are electrically coupled in pairs. In the embodiment shown in FIG. 4, each two opposing rod electrodes are electrically coupled together and each of them then is electrically coupled to a trapping field source 422 which is capable of supplying an RF voltage. Rod electrodes 410, 412, 414 and 416 have appropriate hyperbolic contours to generate a two-dimensional quadrupole electric field inside cavity 404 to constrain the ions in the x and y dimensions. Unlike in the conventional two-dimensional quadrupole mass spectrometer where a weak DC field is used to contain ions of a highly limited range of mass-to-charge ratios, the confinement structure 402 according to the embodiment shown in FIG. 4 allows ions of a wide range of masses to move in and out in the z-direction through end openings 406 and 408, and opening 420 when the detector 418 is positioned at the end opening 408.

The main RF voltage is applied to the rod electrodes from the field source 422 through transformers 424, 438. As shown in FIG. 4, transformers 424 and 438 are electrically coupled so that the main RF signal is applied to each rod through legs 430, 432, 434, and 436 respectively whereby adjacent rods (such as rods 410, 414) are 180° out-of-phase and opposing rods (such as rods 410, 412) are in-phase. This arrangement generates a trapping field which gives trapped ions discrete frequencies of oscillation in the x and y directions, where x and y are the directions orthogonal to the direction of the ion beam, i.e., the z-direction.

An excitation electronics 440 is electrically coupled to a pair of the rod electrodes 410 and 412. Excitation electronics 440 is capable of continuously applying an excitation signal to the rod electrodes 410 and 412 and therefore to affect the electric field distribution in bore 404. For the embodiment shown in FIG. 4, the excitation electronics 440 includes a transformer 438. The transformer 438 is electrically coupled to a signal source 442, which can be, for example, a signal generator. Additionally, the transformer 438 is electrically coupled to the rod electrodes 410, 412 through legs 434, 436, respectively in dipolar fashion. That is, the same excitation signal is applied to the rod electrodes 180° out-of-phase.

Referring now to both FIGS. 2 and 4, the following is an example of how mass analysis is performed with the described embodiment of the present invention in FIG. 4. An RF voltage is applied to the rod electrodes 410, 412, 414 and 416 to establish a two-dimensional trapping field in the bore 404. An ion beam 401 is introduced continuously into the bore 404 through opening 406 to form a sample of ions with a mass range. The sample ions are trapped radially in the bore 404 by the two-dimensional trapping field. Each of the sample ions is characterized by a mass-to-charge dependent frequency. Meanwhile, the excitation signal is applied to the bore 404 from signal source 440 through transformer 438 and rod electrodes 410, 412 continuously. The excitation signal has a frequency spectrum that includes characteristic frequencies corresponding to at least one of the mass-to-charge dependent frequencies of motion of the sample ions. In operation, the excitation waveform is chosen so as to excite all ions within the mass range of interest. The amplitude of the excitation signal is chosen sufficient high to cause resonant motions of the trapped ions with at least one of the characteristic frequencies of the excitation signal. The amplitude of the excitation signal is normally in a range of hundreds of millivolts to several volts. This causes ions to move in expanded radii of motion with characteristic frequencies within the frequency spectrum of the excitation signal. These ions continuously moves along with the z-axis as well. Because these ions in resonant motions have expanded radii due to the excitation signal, they are received by the ring-shaped detector 418 to yield a time-domain signal responsive to the received ions. On the other hand, ions are not excited by the excitation signal can pass through the opening 420 without being detected by the ring-shaped detector 418 because they do not have expanded radii. A Fourier transform of the time-domain signal from the detector results in a frequency spectrum that can be calibrated to yield a mass spectrum. Because the ion beam 401 is continuously fed into the bore 404 and the excitation signal likewise is continuously applied to the cavity 404, trapped ions are continuously excited and received by the detector 418, resulting in a continuous current signal.

The Ion Cyclotron Resonance Embodiment

FIG. 5 partially shows a continuous beam Fourier transform mass spectrometer 500 according to yet another embodiment of the present invention in a cut-away, side-view. The spectrometer 500 includes a cell structure 502. Cell structure 502 includes plate electrodes 510, 512, 514 and 516. Among them, two can be chosen as transmitter plates which, as discussed below, are used to apply an excitation signal to the cell structure 502. The other two can be chosen as receiver plates which, as further discussed below, are used to detect the motion of the trapped ions. For the embodiment shown in FIG. 5, plate electrodes 510, 512 are transmitter plates, and plate electrodes 514, 516 are receiver plates.

These plate electrodes are spaced parallel and apart from each other to define a bore 504. The bore 504 extends axially between the opening ends 506, 508 of the cell structure 502. Bore 504 has a longitudinal axis along the z-direction. Bore 504 is centered in a strong, uniform magnetic field B. The magnetic filed has a direction along the z-axis. Normally, the magnetic field is in the range of 0.5–10 teslas.

An ion beam 501 can be introduced into bore 504 through opening 506 as shown in FIG. 5. Ion beam 501 can have ions with different physical properties such as different mass, different charge, etc. In other words, ion beam 501 can have ions within a mass spectrum. Once inside bore 504, each ion is constrained to move in circular orbits, with motion confined perpendicular to the magnetic field (xy plane) but not restricted parallel to the magnetic field along the z-axis. All trapped ions of a given m/z (mass/charge) have the same cyclotron frequency but have random positions inside bore 504. The net motion of the ions under these conditions does not generate a detectable signal on the receiver plates 514, 516 because of the random locations of ions. To detect cyclotron motion, an excitation signal must be applied to the confinement structure 502 so that the ions "bunch" together spatially into a coherently orbiting ion packet. This excitation signal also increases the radius of the orbiting ion packet so that it closely approaches the receiver plates 514, 516.

An excitation electronics 540 is electrically coupled to a pair of the transmitter plate electrodes 510 and 512. Excitation electronics 540 is capable of continuously applying an excitation signal to the plate electrodes 510 and 512 and therefore to affect the electric field distribution in bore 504. The excitation signal is necessary to generate a detectable signal. For the embodiment shown in FIG. 5, the excitation electronics 540 includes a transformer 538. The transformer 538 is electrically coupled to a signal source 542, which can be, for example, a signal generator. The transformer 538 is electrically coupled to the plate electrodes 510, 512 through legs 534, 536, respectively in dipolar fashion. That is, the same excitation signal is applied to the plate electrodes 510, 512 180° out-of-phase.

An amplifier 522 is electrically coupled to the receiver plate electrodes 514, 516. When the net coherent ion motion produces a time-dependent signal (often termed as the "image current") on the receiver plate electrodes 514, 516, representing the coherent motions of all excited ions in the bore 504, amplifier 522 receives the image current, converts it into a voltage signal and amplifies it. The amplified signal can then be Fourier transformed to yield a frequency spectrum that contains complete information about frequencies and abundances of all ions trapped in the bore 504.

Referring now to both FIGS. 2 and 5, the following is an example of how mass analysis is performed with the described embodiment of the present invention in FIG. 5. The cell structure 502 is placed in a uniform magnetic field B to establish a two-dimensional trapping field in the bore 504. An ion beam 501 is introduced continuously into the bore 504 through opening 506 to form a sample of ions with a mass range. The sample ions are constrained to move in circular orbits in the bore 504 because of the trapping by the magnetic field but free to move along the z-axis. Each of the sample ions is characterized by a mass-to-charge dependent frequency. Meanwhile, the excitation signal is applied to the bore 504 from signal source 542 through transformer 538 and transmitter plate electrodes 510, 512 continuously. The excitation signal has a frequency spectrum that includes characteristic frequencies corresponding to at least one of the mass-to-charge dependent frequencies of motion of the sample ions. In operation, the excitation waveform is chosen so as to excite all ions within the mass range of interest. The amplitude of the excitation signal is chosen sufficient high to cause resonant motions of the trapped ions with at least one of the characteristic frequencies of the excitation signal. However, the amplitude of the excitation signal should be controlled not too high to avoid exciting the ions to such a large radius that they collide with the plate electrodes and are ejected from these plates. The amplitude of the excitation signal is normally in a range of hundreds of millivolts to several volts. This causes ions to move in expanded radii of motion with characteristic frequencies within the frequency spectrum of the excitation signal. These ions continuously moves along with the z-axis. Because these ions in resonant motions gave expanded radii due to the excitation signal, they generate an image current in the receiver plate electrodes 5514, 516. Amplifier 522 receives the image current, converts it into a voltage signal and amplifies it. A Fourier transform of the voltage signal from the amplifier 522 results in a frequency spectrum that can be used to yield a mass spectrum. Because the ion beam 501 is continuously fed into the bore 504 and the excitation signal likewise is continuously applied to the bore 504, trapped ions are continuously excited into coherent motion and detected by the receiver plate electrodes 514, 516, resulting in a continuous image current signal.

Although the present invention has been described with reference to specific details of certain embodiments thereof, it is not intended that such details should be regarded as limitations upon the scope of the invention except as and to the extent that they are included in the accompanying claims. It will be readily appreciated that many deviations may be made from the specific embodiments disclosed in this specification without departing from the invention. For example, instead of continuously introducing an ion beam into the confinement structure, a beam of ionizing radiation can be introduced into the confinement structure to continuously form ions that can be mass analyzed according to the present invention. Accordingly, the scope of the invention is to be determined by the claims below rather than being limited to the specifically described embodiments above.

What is claimed is:

1. A continuous beam Fourier transform mass spectrometer comprising:

a. a confinement structure having a cavity, a first opening and a second opening;

b. means for applying an RF voltage to the structure to form a trapping field in the cavity;

c. means for supplying a continuous beam of ions through the first opening to the cavity to form a sample of ions with a range of masses, wherein the sample ions are trapped in the trapping field and each ion is characterized by a mass-to-charge dependent frequency of motion;

d. means for continuously applying an excitation signal having a frequency spectrum and an amplitude to the trapped sample ions, wherein the frequency spectrum of the excitation signal includes characteristic frequencies corresponding to at least one of the mass-to-charge dependent frequencies of motion of the sample ions, and the amplitude of the excitation signal is sufficiently high to cause resonant motions of the ions with at least one of the characteristic frequencies of the excitation signal; and e. means for detecting signals responsive to the resonant motions of the ions, wherein the second opening allows at least some of the sample ions to exit the cavity.

2. The mass spectrometer of claim 1, further comprising means for converting the signals responsive to the resonant motions of the ions into a frequency spectrum.

3. The mass spectrometer of claim 2, further comprising means for converting the frequency spectrum into a mass spectrum.

4. The mass spectrometer of claim 1, wherein the confinement structure comprises a structure defining a three-dimensional trapping field.

5. The mass spectrometer of claim 4, wherein the three-dimensional trapping field comprises an electric field.

6. The mass spectrometer of claim 1, wherein the confinement structure comprises a structure defining a two-dimensional trapping field.

7. The mass spectrometer of claim 6, wherein the two-dimensional trapping field comprises an electric field.

8. The mass spectrometer of claim 6, wherein the two-dimensional trapping field comprises a uniform magnetic field.

9. A continuous beam Fourier transform mass spectrometer comprising:

a. a quadrupole structure having end caps and a ring electrode, the end caps and the ring electrode spaced apart from each other thereby defining a cavity, the cavity communicating with outside through a first opening and a second opening;

b. RF voltage means for applying an RF voltage to the ring electrode to form a three-dimensional trapping field in the cavity;

c. ion beam means for supplying a continuous beam of ions through the first opening to the cavity to form a sample of ions with a range of masses, wherein the sample ions are trapped in the trapping field and each ion is characterized by a mass-to-charge dependent frequency of motion;

d. excitation means for continuously applying an excitation signal having a frequency spectrum, the frequency spectrum including characteristic frequencies corresponding to at least one of the mass to charge dependent frequencies of motion, to at least one of the end caps to cause resonant motions of the trapped sample ions with at least one of the characteristic frequencies of the excitation signal, wherein the ions in resonant motions are ejected away from the cavity through the second opening continuously thereby to form a current; and e. means for detecting the current.

10. The mass spectrometer of claim 9, further comprising means for converting the current into a frequency spectrum.

11. The mass spectrometer of claim 10, further comprising means for converting the frequency spectrum into a mass spectrum.

12. The mass spectrometer of claim 9, wherein the excitation means includes means for applying the excitation signal across the end caps in dipolar fashion.

13. The mass spectrometer of claim 12, wherein the excitation means comprises a transformer.

14. The mass spectrometer of claim 9, wherein the excitation means includes means for applying the excitation signal to one of the end caps in monopolar fashion.

15. The mass spectrometer of claim 9, wherein the detecting means is electrically detached from the end caps and the current includes a DC component and an AC component.

16. The mass spectrometer of claim 15, wherein the detecting means comprises means for selectively detecting the AC component of the current.

17. The mass spectrometer of claim 9, wherein the detecting means is electrically connected to at least one of the end caps and comprises means for detecting the image current induced by the ions in resonant motions.

18. A continuous beam Fourier transform mass spectrometer comprising:

a. a quadrupole structure having a plurality of linear quadrupole rods, the linear quadrupole rods spaced parallel and apart from each other thereby defining a bore extending axially between the ends of the structure, the bore having a longitudinal axis;

b. RF voltage means for applying RF voltage signals selectively to the rods so that voltage signals applied to adjacent rods are 180° out-of-phase and voltage signals applied to opposing rods are in-phase thereby to form a two-dimensional trapping field radially in the bore;

c. ion beam means for supplying a continuous beam of ions through one end of the structure to the bore along the longitudinal axis to form a sample of ions with a range of masses, wherein the sample ions are trapped in the trapping field and each ion is characterized by a mass-to-charge dependent frequency of motion;

d. excitation means for continuously applying an excitation signal having a frequency spectrum, the frequency spectrum including characteristic frequencies corresponding to at least one of the mass to charge dependent frequencies of motion, to a pair of opposing rods to cause resonant motions of the trapped sample ions with at least one of the characteristic frequencies of the excitation signal, wherein the ions in resonant motions move in expanded radii of motion; and e. means for detecting the ions in resonant motions.

19. The mass spectrometer of claim 18, wherein the excitation means includes means for applying the excitation signal across the opposing rods in dipolar fashion.

20. The mass spectrometer of claim 19, wherein the excitation means comprises a transformer.

21. The mass spectrometer of claim 18, wherein the detecting means comprises a ring-shaped plate closing one end of the bore, the plate having a first radius and a second radius defining an opening, wherein the first radius is selected to fit the bore and the second radius is selected to allow ions not in resonant motions to pass through the opening undetected and to allow the ions in resonant motions to be received by the plate thereby to yield a current.

22. The mass spectrometer of claim 21, further comprising means for converting the signals corresponding to the current into a frequency spectrum.

23. The mass spectrometer of claim 22, further comprising means for converting the frequency spectrum into a mass spectrum.

24. A continuous beam Fourier transform mass spectrometer comprising:

a. a cell structure having a first pair and second pair of opposing plates and a bore extending between the ends of the structure, the bore having a longitudinal axis;

b. means for applying a uniform magnetic field in the bore, the magnetic field having a direction parallel to the longitudinal axis thereby to form a two-dimensional trapping field radially in the bore;

c. ion beam means for supplying a continuous beam of ions through one end of the structure to the bore along the longitudinal axis to form a sample of ions with a range of masses, wherein the sample ions are trapped radially in the bore and each ion is characterized by a mass-to-charge dependent frequency of motion;

d. excitation means for continuously applying an excitation signal having a frequency spectrum and an amplitude to the first pair of opposing plates to cause resonant motions of the trapped sample ions with at least one of the characteristic frequencies of the excitation signal, wherein the ions in resonant motions move in expanded radii of motion thereby to approach the second pair of the opposing plates and induce an image current therein; and e. means for detecting the image current.

25. The mass spectrometer of claim 24, further comprising means for converting the image current into a frequency spectrum.

26. The mass spectrometer of claim 25, further comprising means for converting the frequency spectrum into a mass spectrum.

27. The mass spectrometer of claim 24, wherein the excitation means comprises a transformer.

28. The mass spectrometer of claim 24, wherein the detecting means comprises an amplifier.

29. A method of mass analyzing ions trapped in a confinement structure, wherein the confinement structure has a cavity, comprising:

a. forming a trapping field in the cavity;

b. supplying a continuous beam of ions to form a sample of ions with a range of masses in the cavity, wherein the sample ions are trapped in the trapping field and each ion is characterized by a mass-to-charge dependent frequency of motion;

c. continuously applying an excitation signal having a frequency spectrum and an amplitude to the trapped sample ions, wherein the frequency spectrum of the excitation signal includes characteristic frequencies corresponding to at least one of the mass-to-charge dependent frequencies of motion of the sample ions, and the amplitude of the excitation signal is sufficiently high to cause resonant motions of the ions with at least one of the characteristic frequencies of the excitation signal; and d. detecting signals responsive to the resonant motions of the ions.

30. The method of claim 29, further comprising the step of converting the signals responsive to the resonant motions of the ions into a frequency spectrum.

31. The method of claim 30, further comprising the step of converting the frequency spectrum into a mass spectrum.

32. The method of claim 29, wherein the trapping field is a three-dimensional electric field.

33. The method of claim 29, wherein the trapping field is a two-dimensional electric field.

34. The method of claim 29, wherein the trapping field is a uniform magnetic field.

35. A method of mass analyzing ions trapped in a quadrupole structure, wherein the structure has a cavity, a first opening and a second opening, comprising:

a. applying an RF voltage to the quadrupole structure to form a trapping field in the cavity;

b. supplying a continuous beam of ions through the first opening to the cavity to form a sample of ions with a range of masses, wherein the sample ions are trapped in the trapping field and each ion is characterized by a mass-to-charge dependent frequency of motion;

c. continuously applying an excitation signal having a frequency spectrum and an amplitude to the trapped sample ions, wherein the frequency spectrum of the excitation signal includes characteristic frequencies corresponding to at least one of the mass-to-charge dependent frequencies of motion of the sample ions, and the amplitude of the excitation signal is sufficiently high to cause resonant motions of the ions with at least one of the characteristic frequencies of the excitation signal; and d. detecting signals responsive to the resonant motions of the ions.

36. The method of claim 35, further comprising the step of converting the signals responsive to the resonant motions of the ions into a frequency spectrum.

37. The method of claim 36, further comprising the step of converting the frequency spectrum into a mass spectrum.

38. The method of claim 35, wherein the trapping field is a three-dimensional electric field.

39. The method of claim 38, wherein the signals responsive to the resonant motions of the ions comprise a current, the current being formed by a flux of the ions in resonant motions which are ejected away from the cavity through the second opening.

40. The method of claim 35, wherein the trapping field is a two-dimensional electric field.

41. The method of claim 40, wherein the signals response to the resonant motions of the ions comprise a current, the current being formed in response to the ions in resonant motions which move in expanded radii of motion.

42. A method of mass analyzing ions trapped in a cell structure, wherein the cell structure has a bore, the bore having a longitudinal axis and extending axially between a first and a second openings, comprising:

a. applying a magnetic field to the cell structure to form a trapping field in the bore, the magnetic field having a direction along the longitudinal axis;

b. supplying a continuous beam of ions through the first opening to the bore to form a sample of ions with a range of masses, wherein the sample ions are constrained radially in the trapping field and each ion is characterized by a mass-to-charge dependent frequency of motion;

c. continuously applying an excitation signal having a frequency spectrum and an amplitude to the trapped sample ions, wherein the frequency spectrum of the excitation signal includes characteristic frequencies corresponding to at least one of the mass-to-charge dependent frequencies of motion of the sample ions, and the amplitude of the excitation signal is sufficiently high to cause resonant motions of the ions with at least one of the characteristic frequencies of the excitation signal; and d. detecting the signals responsive to the resonant motions of the ions.

43. The method of claim 42, further comprising the step of converting the signals responsive to the resonant motions of the ions into a frequency spectrum.

44. The method of claim 43, further comprising the step of converting the frequency spectrum into a mass spectrum.

45. The method of claim 42, wherein the magnetic field is uniform.

46. A method of analyzing ions trapped in a confinement structure by a trapping field, comprising:

a. applying an excitation signal continuously to the confinement structure to cause resonant motions of the ions; and b. detecting signals responsive to the resonant motions of the ions.

47. The method of claim 46, further comprising the step of converting the signals responsive to the resonant motions of the ions into a frequency spectrum.

48. The method of claim 47, further comprising the step of converting the frequency spectrum into a mass spectrum.

* * * * *